US010459383B2

(12) United States Patent
Sato

(10) Patent No.: US 10,459,383 B2
(45) Date of Patent: Oct. 29, 2019

(54) FIXING DEVICE AND IMAGE FORMING APPARATUS

(71) Applicant: Oki Data Corporation, Tokyo (JP)

(72) Inventor: Haruo Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/249,878

(22) Filed: Jan. 16, 2019

(65) Prior Publication Data

US 2019/0235425 A1 Aug. 1, 2019

(30) Foreign Application Priority Data

Jan. 26, 2018 (JP) ..... 2018-011079

(51) Int. Cl.
*G03G 15/20* (2006.01)

(52) U.S. Cl.
CPC ..... *G03G 15/2053* (2013.01); *G03G 15/206* (2013.01)

(58) Field of Classification Search
CPC ..... G03G 15/206; G03G 15/2053; G03G 15/2064; G03G 2215/20; G03G 2215/2035; G03G 2215/2038
USPC ..... 399/107, 110, 122, 320, 328, 329
See application file for complete search history.

(56) References Cited

U.S. PATENT DOCUMENTS 7,376,379 B2 * 5/2008 Takahashi ..... C22C 19/03 399/329
7,536,145 B2 * 5/2009 Tomine ..... G03G 15/2017 399/328
9,229,379 B2 * 1/2016 Tamaki ..... G03G 15/2017

FOREIGN PATENT DOCUMENTS

JP 2010-32697 A 2/2010

* cited by examiner

*Primary Examiner* — Hoan H Tran
(74) *Attorney, Agent, or Firm* — Metrolex IP Law Group, PLLC

(57) ABSTRACT

A fixing device according an embodiment includes a belt unit and a pressure member. The belt unit includes a supporter, an endless belt movably supported by the supporter, a heater provided inside the endless belt, and a thermal diffusion member including: a first surface in contact with the heater; a second surface in contact with an inner surface of the endless belt; a first wall provided upstream of the heater in a transport direction of a medium; and a second wall provided downstream of the heater in the transport direction. The supporter includes first and second grooves in which the first and second walls are provided respectively. Upon applying a pressing force toward the supporter to the outer surface of the endless belt by the pressure member, the thermal diffusion member and the heater are in contact with each other while being pressed toward a contact surface of the supporter.

14 Claims, 9 Drawing Sheets

FIXING DEVICE AND IMAGE FORMING APPARATUS

CROSS REFERENCE TO RELATED APPLICATIONS

This application claims priority based on 35 USC 119 from prior Japanese Patent Application No. JP2018-011079 filed on Jan. 26, 2018, entitled "FIXING DEVICE AND IMAGE FORMING APPARATUS", the entire contents of which are incorporated herein by reference.

BACKGROUND

The disclosure relates to a fixing device that fixes a developer image onto a medium, and an image forming apparatus including the fixing device.

A fixing device has been proposed which includes: a belt unit (heating device) including an endless belt (endless film) and a heating unit (heater), and a pressure member (pressure roller) that comes into contact with the outer surface of the endless belt (see, for instance, claim 1, and FIG. 1 in Patent Document 1: Japanese Patent Application Publication No. 2010-032697). The fixing device fixes a developer image onto a medium (recording material) by allowing the medium to pass through a nip between the endless belt and the pressure member.

Patent Document 1: Japanese Patent Application Publication No. 2010-032697

SUMMARY

The heating unit of the fixing device may include a heater body, and a sliding member (thermal diffusion member) which is in contact with the inner surface of the endless belt. In this case, thermal conductive grease applied between the heater body and the thermal diffusion member may leak out and adhere to both the lower surface of the thermal diffusion member and the inner surface of the endless belt, and may be mixed with slide grease between the members, which reduces sliding performance, causes a variation in heat transfer coefficient, and insufficient heating of the developer image, thus a fixing failure tends to occur.

The disclosure aims to provide a fixing device capable of favorably fixing a developer image, and an image forming apparatus including the fixing device.

An aspect of the disclosure is a fixing device that includes: a belt unit; and a pressure member, wherein a medium is passed through a contact position between the belt unit and the pressure member so that a developer image is fixed onto the medium. The belt unit includes: a supporter; an endless belt that is movably supported by the supporter and includes an outer surface which comes in contact with the pressure member; a heater that is disposed inside the endless belt; and a thermal diffusion member that transmits heat generated by the heater to the endless belt. The thermal diffusion member includes: a first surface in contact with the heater; a second surface in contact with an inner surface of the endless belt; a first wall provided upstream of the heater in a transport direction of the medium; and a second wall provided downstream of the heater in the transport direction. The supporter includes: a first groove in which the first wall is provided; and a second groove in which the second wall is provided. In a state where a pressing force toward the supporter is applied to the outer surface of the endless belt by the pressure member, the thermal diffusion member and the heater are in contact with each other while being pressed toward a contact surface of the supporter.

According to the aspect, a developer image can be favorably fixed.

DETAILED DESCRIPTION

Figure 1:
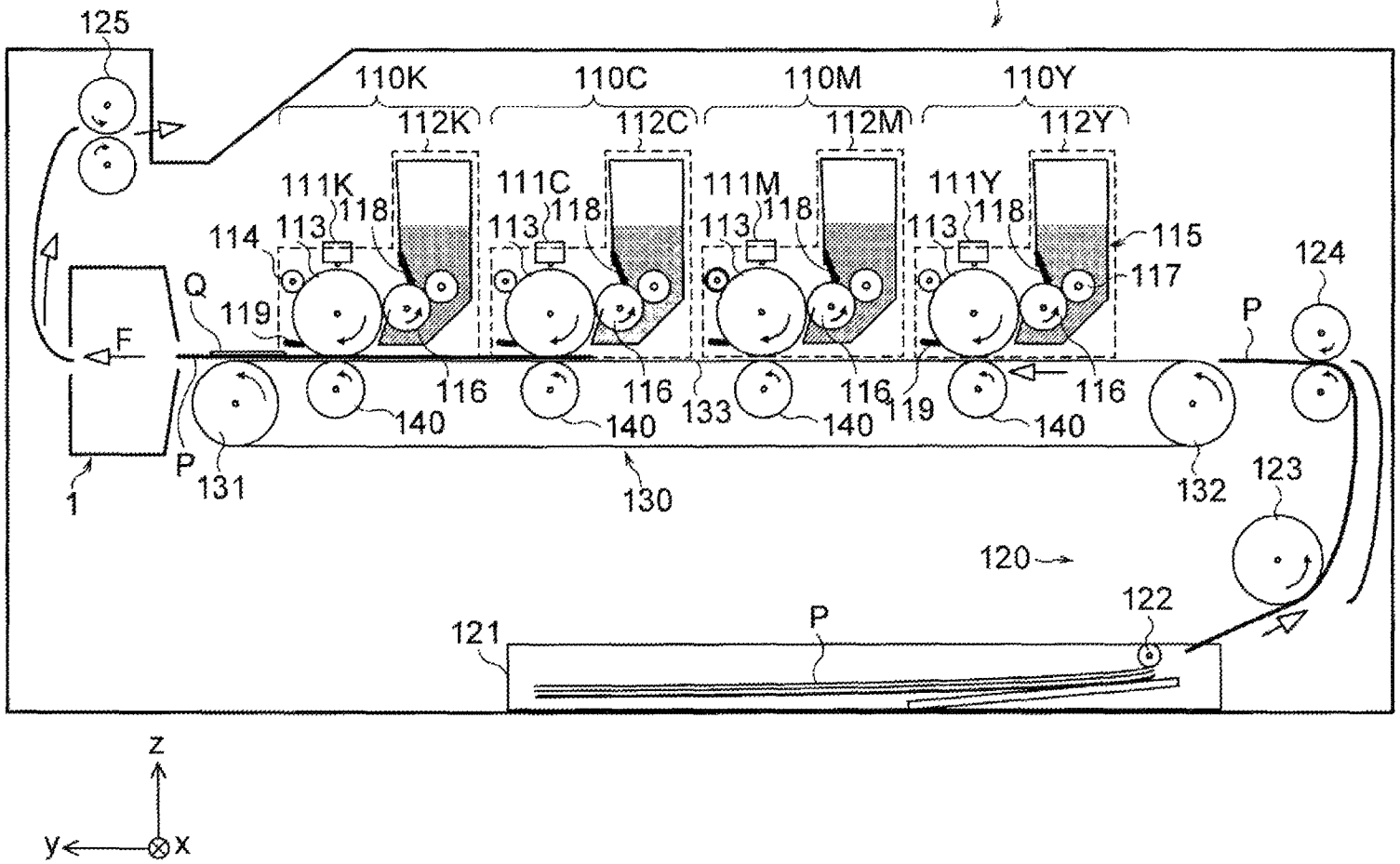
FIG. 1 is a diagram schematically illustrating a view of the configuration of an image forming apparatus according to one or more embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only. Hereinafter, a fixing device and an image forming apparatus according to an embodiment of the disclosure are described with reference to the accompanying drawings.

In the drawings, the coordinate axes of xyz orthogonal coordinate system are illustrated. Z-axis is the coordinate axis parallel to the height direction of the fixing device. +Z axis direction is the upward direction, and −z axis direction is the downward direction. In general, −z axis direction is the gravitational direction, but may be inclined to the gravitational direction. Y axis is the coordinate axis parallel to a transport direction F of a medium P in the fixing device. +Y axis direction is the transport direction F in the fixing device. X axis is the coordinate axis parallel to the width direction of the endless belt, in other words, the coordinate axis parallel to the supporting shaft of the pressure roller.

<<1>> Image Forming Apparatus

FIG. 1 is a diagram illustrating a schematic view of the configuration of an image forming apparatus 100 according to an embodiment. The image forming apparatus 100 is an electrophotographic color printer. The image forming apparatus 100 includes a fixing device 1 according to the embodiment.

As illustrated in FIG. 1, as the main components, the image forming apparatus 100 includes image formers 110Y, 110M, 110C, and 110K that form a developer image (toner image) on a medium P such as paper by an electrophotographic system; a medium supply unit 120 that supplies the medium P to the image formers 110Y, 110M, 110C, and 110K; a transporter 130 that transports the medium P; transfer rollers 140, as transferring units, that are disposed corresponding to the image formers 110Y, 110M, 110C, and 110K; the fixing device 1 that fixes a developer image Q transferred onto the medium P; and a paper exit roller pair 125, as a medium discharger, that discharges the medium P, which has passed through the fixing device 1, to the outside. It should be noted that the number of the image formers included in the image forming apparatus 100 may be three or less and five or greater. Also, as long as the image forming apparatus 100 forms an image on the medium P by an electrophotographic process, the image forming apparatus 100 may be a monochrome printer that has one image former.

As illustrated in FIG. 1, the medium supply unit 120 includes a paper cassette 121, a hopping roller 122 that feeds the medium P stacked in the paper cassette 121 one by one, a resist roller 123 that transports the medium P fed from the paper cassette 121, and a roller pair 124 that transports the medium P.

The image formers 110Y, 110M, 110C, and 110K form a yellow (Y) developer image, a magenta (M) developer image, a cyan (C) developer image, and a black (K) developer image, respectively, on the medium P. The image formers 110Y, 110M, 110C, and 110K are disposed side by side in the transport direction (specifically, from the right to the left in FIG. 1) along a medium transport path. The image formers 110Y, 110M, 110C, and 110K respectively include detachably attached image forming units 112Y, 112M, 112C, and 112K for respective colors.

The image formers 110Y, 110M, 110C, and 110K respectively include optical printing heads 111Y, 111M, 111C, and 111K as exposure devices for respective colors.

Each of the image forming units 112Y, 112M, 112C, and 112K includes a photoconductor drum 113, as an image carrier, that is rotatably supported; a charging roller 114, as a charging member, that uniformly charges the surface of the photoconductor drum 113; a developing device 115 that supplies toner to the surface of the photoconductor drum 113 to form a developer image corresponding to an electrostatic latent image which has been formed on the surface of the photoconductor drum 113 due to exposure by the optical printing heads 111Y, 111M, 111C, and 111K.

The developing device 115 includes a toner storage, as a developer storage, that forms developer storage space for storing toner; a developing roller 116, as a developer carrier, that supplies toner to the surface of the photoconductor drum 113; a supply roller 117 that supplies the toner stored in the toner storage to the developing roller 116; and a developing blade 118, as a toner regulating member, that regulates the thickness of a toner layer on the surface of the developing roller 116.

Exposure to the uniformly charged surface of the photoconductor drum 113 is performed by each of the optical printing heads 111Y, 111M, 111C, and 111K is based on image data for printing. Each of the optical printing heads 111Y, 111M, 111C, and 111K includes a light emitting device array, in which multiple light emitting devices are arranged.

As illustrated in FIG. 1, the transporter 130 includes a transport belt (transfer belt) 133 that electrostatically adsorbs onto the medium P to transport the medium P; a drive roller 131 that is rotated by a drive unit and drives the transport belt 133; and a tension roller (driven roller) 132 that forms a pair with the drive roller 131 to stretch the transport belt 133.

As illustrated in FIG. 1, each transfer roller 140 is disposed to be opposed to the photoconductor drum 113 of a corresponding one of the image forming units 112Y, 112M, 112C, and 112K with the transport belt 133 interposed between the transfer roller 140 and the photoconductor drum 113. A developer image (toner image) formed on the surface of the photoconductor drum 113 of each of the image forming units 112Y, 112M, 112C, and 112K is sequentially transferred by the transfer roller 140 onto the upper surface of the medium P transported in the direction of an arrow along the medium transport path, and a color image, in which multiple developer images are superimposed, is formed. Each of the image forming units 112Y, 112M, 112C, and 112K includes a cleaning device 119 that cleans the toner remaining on the photoconductor drum 113 after the image (developer image) developed on the photoconductor drum 113 is transferred onto the medium P.

The fixing device 1 fixes unfixed developer image Q to the medium P by heating and pressing the unfixed developer image Q.

Next, the operation of the image forming apparatus 100 is described. First, the medium P in the paper cassette 121 is fed by the hopping roller 122, and sent to the resist roller 123. Subsequently, the medium P is sent from the resist roller 123 to the transport belt 133 via the roller pair 124, and is transported the image forming units 112Y, 112M, 112C, and 112K by running of the transport belt 133. In each of the image forming units 112Y, 112M, 112C, and 112K, the surface of the photoconductor drum 113 is charged by the charging roller 114, exposed by a corresponding one of the optical printing heads 111Y, 111M, 111C, and 111K, and an electrostatic latent image is formed. Toner having a reduced layer on the developing roller 116 electrostatically adheres to the electrostatic latent image, and a developer image of each color is formed. The developer image of each color is transferred onto the medium P by the transfer roller 140, and a color developer image Q is formed on the medium P. The toner remaining on the photoconductor drum 113 after the transfer is removed by the cleaning device 119. The medium P, on which the color developer image Q has been formed, is sent to the fixing device 1. The color developer image Q is fixed to the medium P by the fixing device 1, and a color image is formed. The medium P, on which the color image has been formed, is discharged to a paper stacker by the paper exit roller pair 125.

<<2>> Fixing Device

Figure 2:
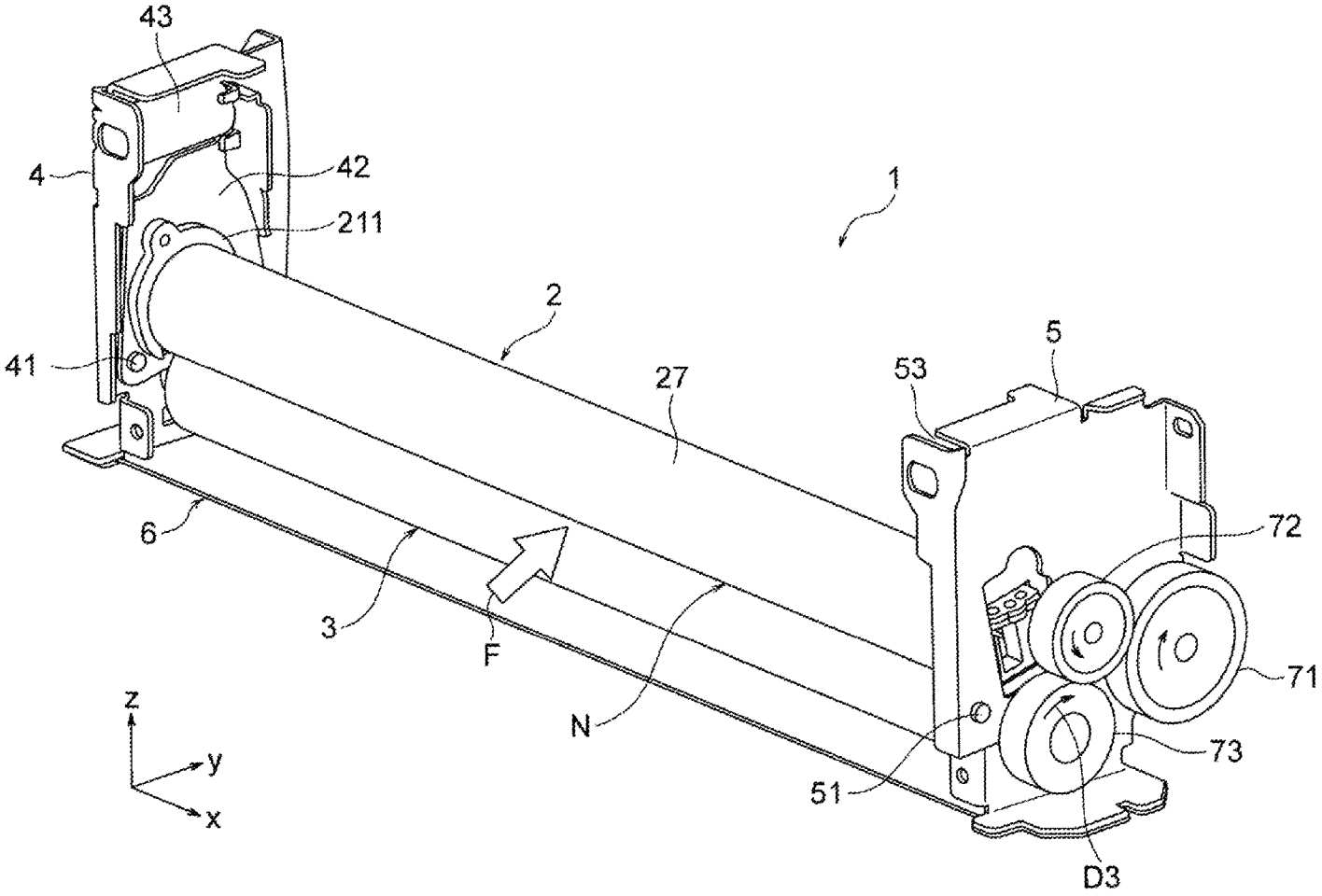
FIG. 2 is a schematic diagram illustrating a perspective view of the inside of a fixing device according to an embodiment.
Figure 3:
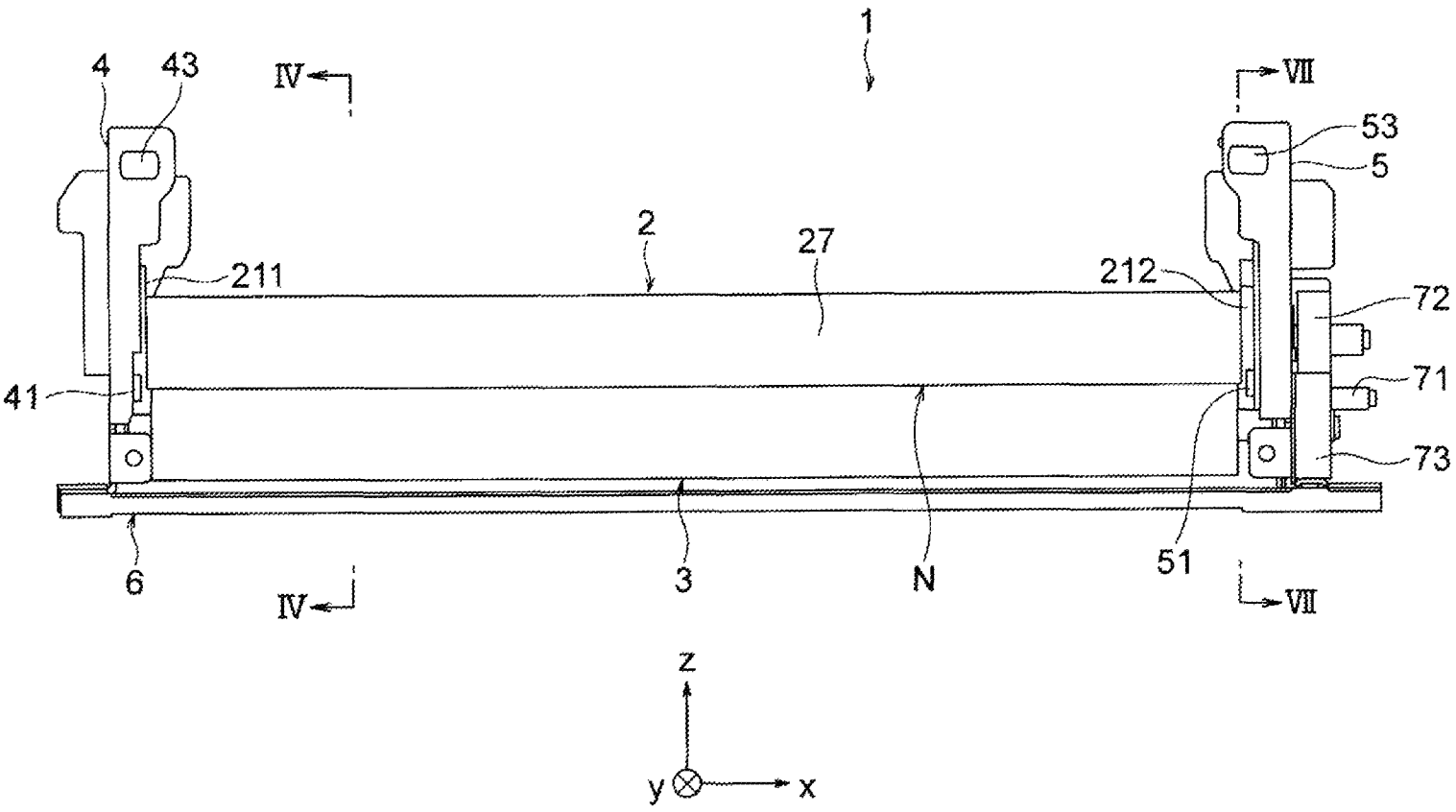
FIG. 3 is a diagram illustrating a front view, as seen in a transport direction of a medium, of the inside of the fixing device.

FIG. 2 is a diagram illustrating a schematic perspective view of the internal structure of the fixing device 1 according to the embodiment. FIG. 3 is a front view, as seen in the transport direction F (+y axis direction) of the medium, of the inside of the fixing device 1

Figure 4:
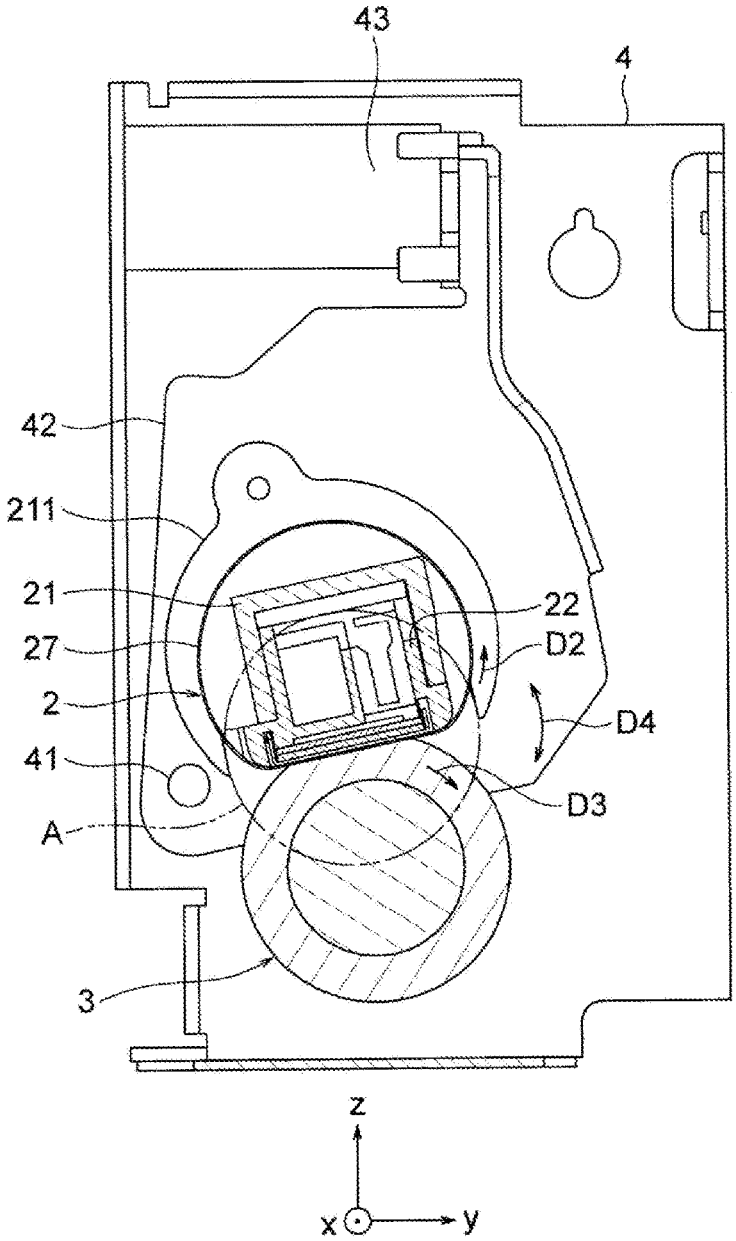
FIG. 4 is a schematic diagram illustrating a cross-sectional view of the fixing device of FIG. 3 taken along line IV-IV.
Figure 5:
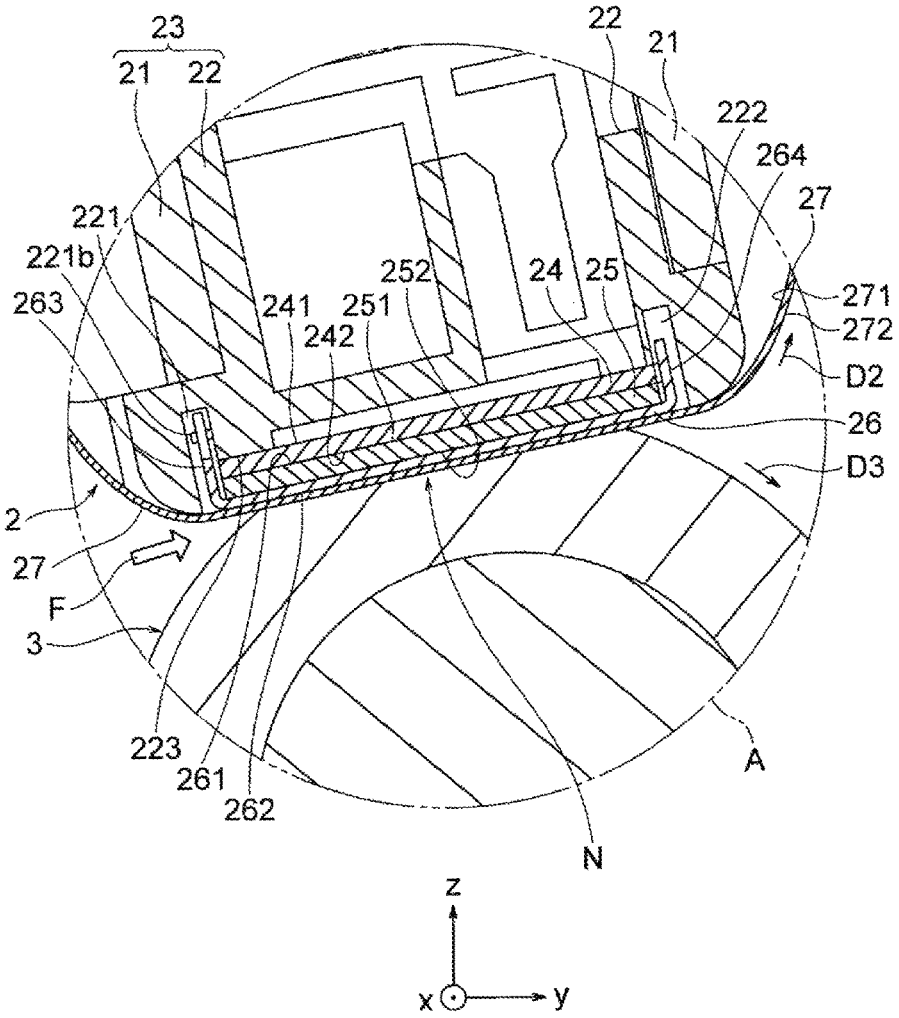
FIG. 5 is a diagram illustrating an enlarged cross-sectional view illustrating A section of the fixing device of FIG. 4.

FIG. 4 is a diagram illustrating a schematic cross-sectional view of the fixing device 1 of FIG. 3 taken along line IV-IV. FIG. 5 is a diagram illustrating an enlarged cross-sectional view illustrating A section of the fixing device 1 of FIG. 4.

Figure 6:
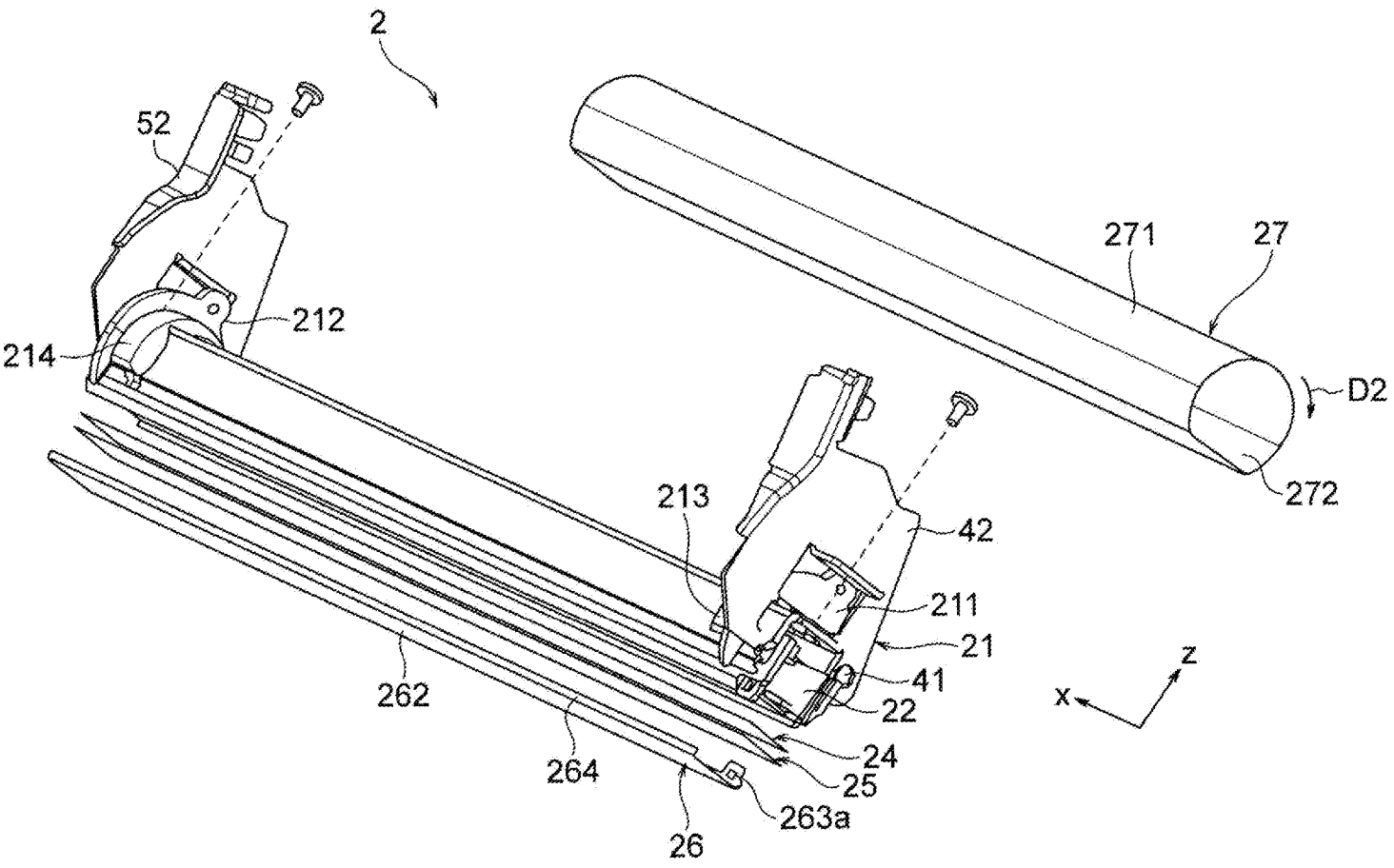
FIG. 6 is a schematic diagram illustrating an exploded perspective view of the structure of a belt unit of the fixing device.
Figure 7:
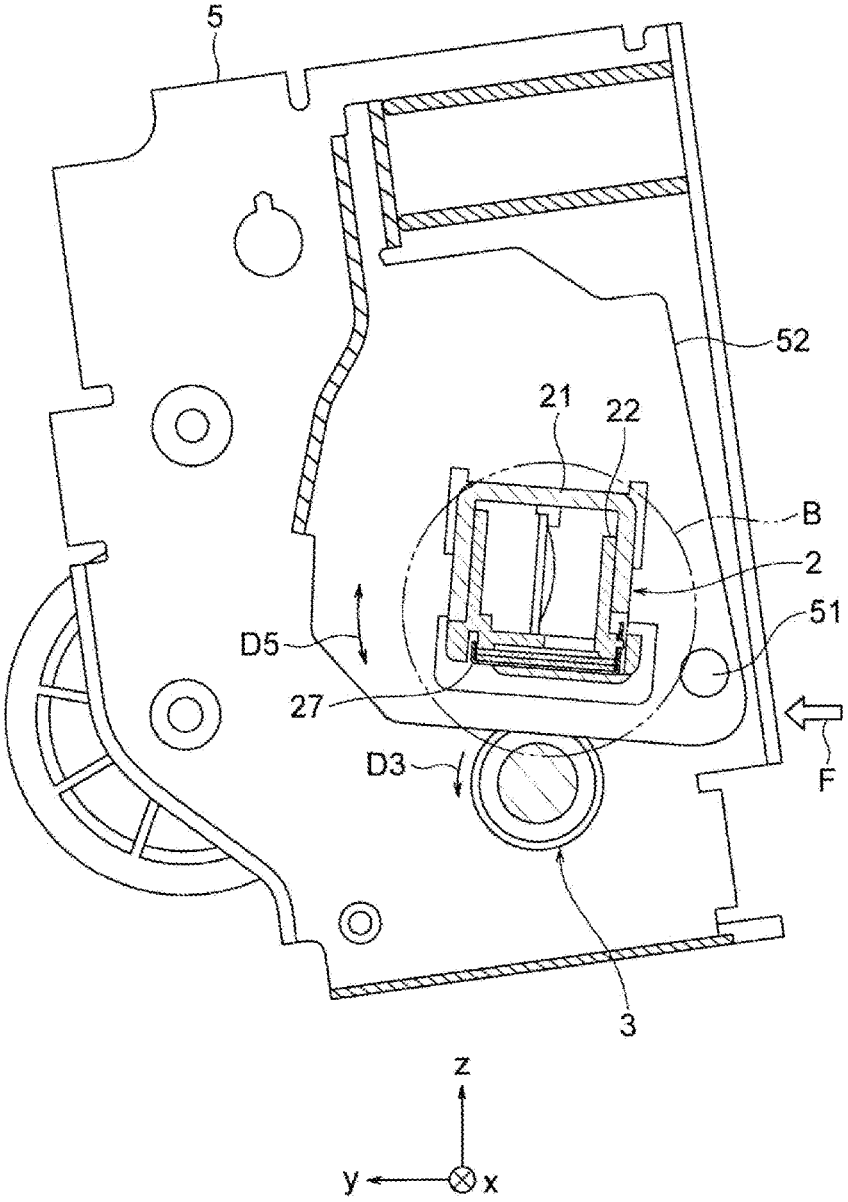
FIG. 7 is a schematic diagram illustrating a cross-sectional view of the fixing device of FIG. 3 taken along line VII-VII.
Figure 8:
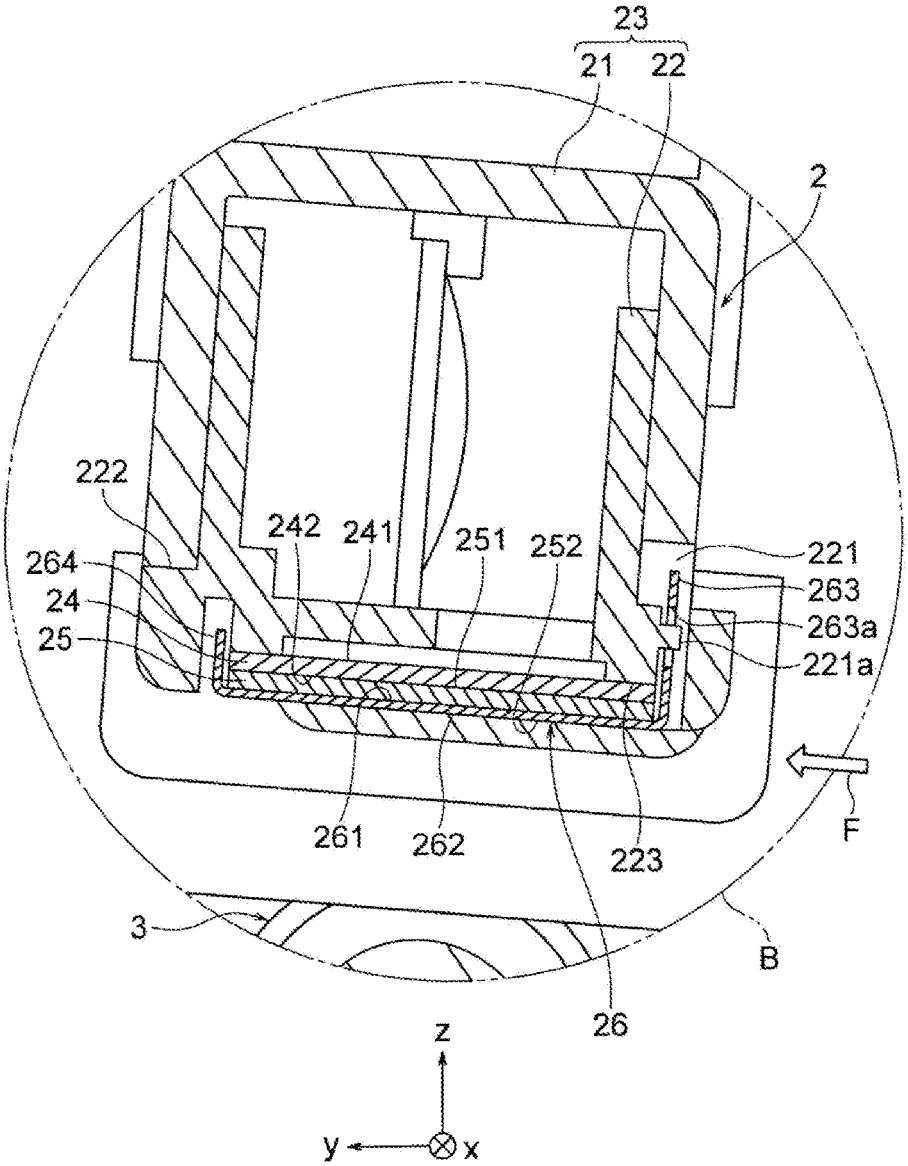
FIG. 8 is a diagram illustrating an enlarged cross-sectional view illustrating B section of the belt unit of FIG. 7.
Figure 9:
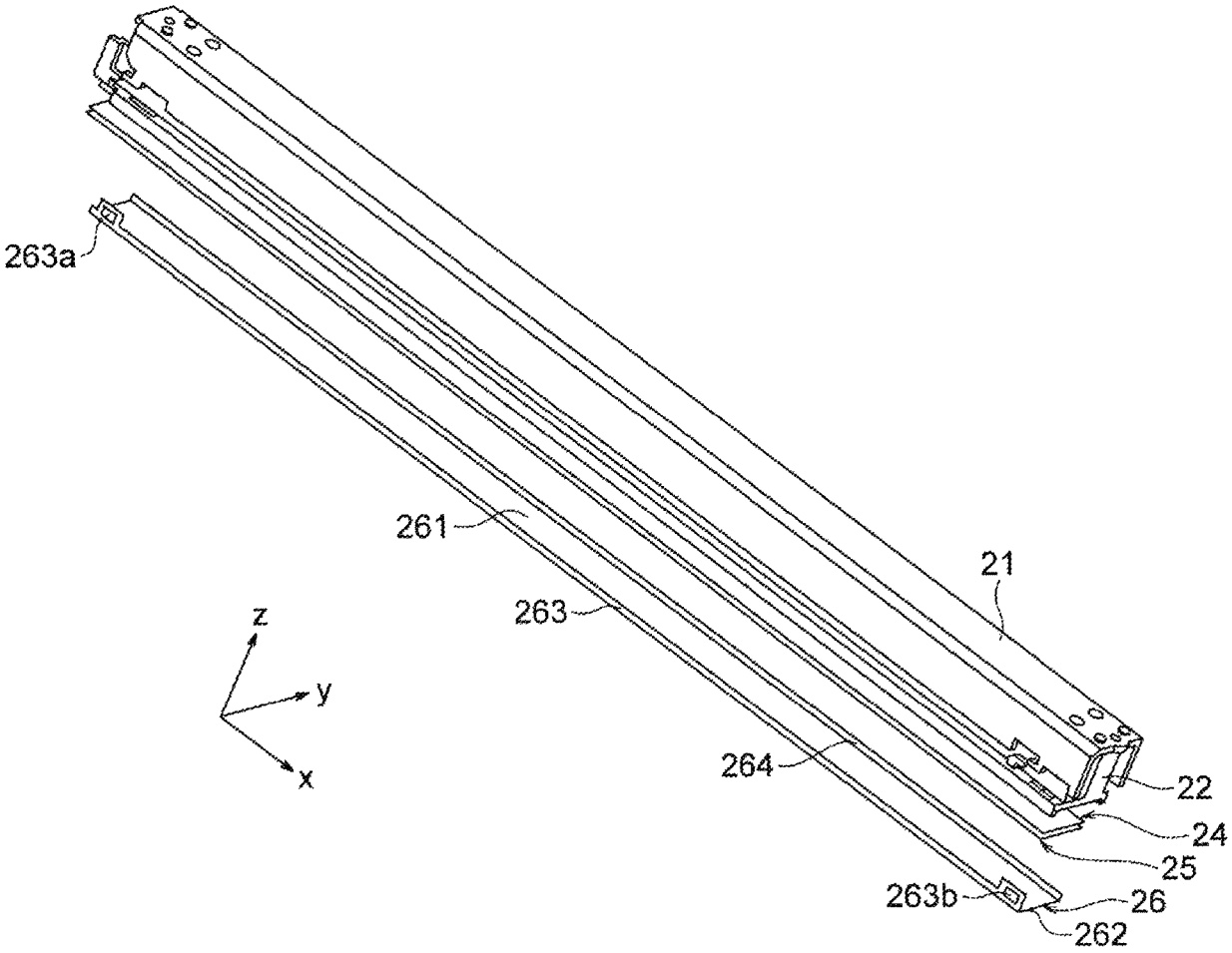
FIG. 9 is a schematic diagram illustrating an exploded perspective view of the structure of the inside of an endless belt of the belt unit of the fixing device.

FIG. 6 is a schematic diagram illustrating a exploded perspective view of the structure of a belt unit 2 of the fixing device 1. FIG. 7 is a schematic diagram illustrating a cross-sectional view of the fixing device 1 of FIG. 3 taken along line VII-VII. FIG. 8 is an enlarged cross-sectional view illustrating B section of the belt unit 2 of FIG. 7. FIG. 9 is a schematic diagram illustrating an exploded perspective view of the structure of the inside of the endless belt of the belt unit 2.

As illustrated in FIGS. 2 and 3, the fixing device 1 includes the belt unit 2 as a heating device; a pressure roller 3, as a pressure member, that comes in contact with the belt unit 2; and side frames 4 and 5 (also referred to as "left-side frame 4" and "right-side frame 5") that support the belt unit 2 and the pressure roller 3. The side frames 4 and 5 are part of a frame 6 that is the body structure of the fixing device 1. The medium P (illustrated in FIG. 1) having an unfixed developer image Q (illustrated in FIG. 1) is transported in the transport direction F, passed through the contact position between the belt unit 2 and the pressure roller 3, in other words, a nip section N, and thus the medium P is heated and pressed, and the developer image Q is fixed onto the medium P.

As illustrated in FIGS. 2 and 3, the side frames 4 and 5 include supporting shafts 41 and 51 that are coaxially disposed. As illustrated in FIGS. 2 and 4, the side frame 4 includes a lever member 42 that is supported rotatably in D4 direction around the supporting shaft 41. As illustrated in FIGS. 6 and 7, the side frame 5 includes a lever member 52 that is supported rotatably in D5 direction around the supporting shaft 51.

As illustrated in FIGS. 4 to 9, the belt unit 2 includes a stay 21, and a retention member 22 fixed to the stay 21. The stay 21 and the retention member 22 constitute a supporter 23 for supporting the belt unit 2 on the side frames 4 and 5. However, the structure of the supporter 23 is not limited to the illustrated example, and various changes may be made. As illustrated in FIGS. 2 to 4 and 6, both ends 211 and 212 of the stay 21 in the x axis direction are fixed to the lever members 42 and 52, respectively. A method of fixing is not limited, and may be fixing with a screw, for instance. Thus, the belt unit 2 is supported along with the lever members 42 and 52 rotatably in the D4 direction of FIG. 4, that is, the D5 direction of FIG. 7 around the supporting shafts 41 and 51.

Also, as illustrated in FIGS. 4 to 9, the belt unit 2 includes a heat retaining plate 24 as a heat retaining member, a heater 25 in a plate shape, a thermal diffusion plate 26 as a thermal diffusion member, and an endless belt 27. The heat retaining plate 24 has heat storage performance for temporarily storing the heat generated by the heater 25, and heat rejection performance for reducing transmission of the heat generated by the heater 25 in upward direction (+z axis direction). However, when the heater 25 has the performance of the heat retaining plate 24 or allows temperature rise of the upper portion of the heater 25, the heat retaining plate 24 does not have to be provided. In addition, the heat retaining plate 24 and the heater 25 are not limited to the plate shape or the flat plate shape.

As illustrated in FIGS. 4 to 9, in order to improve heat transfer characteristics, a lower surface 242 of the heat retaining plate 24 and an upper surface 251 of the heater 25 are brought into intimate contact with each other with pre-applied grease (first grease). The grease (first grease) is thermal conductive grease, for instance. In addition, in order to improve heat transfer characteristics, a lower surface 252 of the heater 25 and a first surface 261 of the thermal diffusion plate 26 are brought into intimate contact with each other with pre-applied grease (second grease). The grease (the second grease) is thermal conductive grease, for instance. The first grease and the second grease may have the same component, or may have different components. The grease may not be applied between the heat retaining plate 24 and the heater 25. In addition, in order to improve sliding performance and to reduce wear, slide grease is applied between the endless belt 27 and a sliding section of the thermal diffusion plate 26.

As illustrated in FIGS. 4 and 5, the heat retaining plate 24, the heater 25, and the thermal diffusion plate 26 are disposed inside the endless belt 27. The heat retaining plate 24, the heater 25, and the thermal diffusion plate 26 form an integral structure by the adhesive power of the grease. When grease is not applied between the heat retaining plate 24 and the heater 25, the heater 25 and the thermal diffusion plate 26 form an integral structure by the adhesive power of the grease.

As illustrated in FIGS. 4 to 6 and 9, the thermal diffusion plate 26 includes a first surface 261 in contact with the lower surface 252 of the heater 25, a second surface 262 serving as a sliding surface in contact with an inner surface 271 of the endless belt 27, a first wall 263 provided on the upstream side of the heater 25 in the transport direction F, and a second wall 264 provided on the downstream side of the heater 25 in the transport direction F. The first wall 263 and the second wall 264 are provided standing generally in +z axis direction, in other words, toward the retention member 22. The first wall 263 and the second wall 264 are provided over the entire area in the longitudinal direction of the thermal diffusion plate 26, that is, x-axis direction. The retention member 22 has a first groove 221 that is an elongated groove into which the first wall 263 is inserted, and a second groove 222 that is an elongated groove into which the second wall 264 is inserted. The first groove 221 and the second groove 222 are formed over the entire area in the longitudinal direction of the retention member 22, that is, x-axis direction. As illustrated in FIGS. 5 and 8, the shape of the cross-section of the thermal diffusion plate 26 is substantially a U shape.

It is preferable that both ends of the thermal diffusion plate 26 in the width direction, that is, x-axis direction be disposed outside both ends of the endless belt 27 in the width direction. This is because although no walls are not present at both ends of the thermal diffusion plate 26 in the width direction, even when the grease leaks out from both ends of the thermal diffusion plate 26 in the width direction, the grease does not adhere to the inner surface of the endless belt 27.

It is preferable that the thermal diffusion plate 26 be a metal plate having a thickness in a range from 0.2 mm to 1.0 mm. In the thermal diffusion plate 26, treatment (for instance, glass coating or hard chrome coating) for reducing the friction coefficient and improving the antiwear performance of the sliding surface in contact with the endless belt 27 is made on a thin plate made of metal, such as stainless steel, aluminum alloy, or iron, for instance. In this case, bent sections formed by bending of the metal plate may be used as the first wall 263 and the second wall 264.

As illustrated in FIGS. 5, 6, 8, and 9, the first wall 263 has engagement holes 263*a* and 263*b* as engagement sections which are engaged with (hooked with or fitted to) projection sections (hooking sections) 221*a* (FIG. 8) and 221*b* (FIG. 5) in the first groove 221. Similar projection sections and engagement holes may be provided in the second wall 264 and the second groove 222 instead of or in addition to the first wall 263 and first groove 221. Alternatively, the first groove 221 may include engagement holes and the first wall 263 may include projection sections which are engaged with (hooked with or fitted to) the engagement holes.

The first groove 221 has such a depth that the leading end of the first wall 263 is out of contact with the bottom surface of the first groove 221, and the second groove 222 has such a depth that the leading end of the second wall 264 is out of contact with a bottom surface of the second groove 222. This structure allows the thermal diffusion plate 26 to move in the depth direction (substantially z axis direction) of the first groove 221 and the second groove 222.

As illustrated in FIGS. 4 to 6, the endless belt 27 is movably supported by guide surfaces 213 and 214 (FIG. 6) on both end sides of the stay 21 in the circumferential direction (D2 direction) of the endless belt 27. As illustrated in FIGS. 4 and 5, the inner surface 271 of the endless belt 27 is slidably in contact with the second surface 262 of the thermal diffusion plate 26.

As illustrated in FIGS. 2 to 4, the outer surface 272 of the endless belt 27 is in contact with the circumferential surface of the pressure roller 3, and the nip section N is formed at the contact position (that is, the contact range) between the endless belt 27 and the pressure roller 3. The pressure roller 3 receives a driving force generated by a driving force generation unit such as a motor, via drive gears 71 to 73, as driving force transmission units, which transmit the driving force, and rotates. The endless belt 27 is moved in the D2 direction which is the circumferential direction of the endless belt 27 by being driven by rotation of the pressure roller 3 in the D3 direction.

As illustrated in FIG. 5, when a fixing operation is performed on the developer image Q, the pressure roller 3 applies a pressing force to the endless belt 27. The pressing force is generated, for instance, by an urging force of springs 43 and 53 as urging units illustrated in FIG. 2 applied to the lever members 42 and 52 in +y direction which are rotatable around the supporting shafts 41 and 51. When a pressing force toward the retention member 22 is applied to the outer surface 272 of the endless belt 27 by the pressure roller 3, the thermal diffusion plate 26, the heater 25, and the heat retaining plate 24 are in an intimate contact state in which the thermal diffusion plate 26, the heater 25, and the heat retaining plate 24 are pressed toward the retention member 22. In other words, the intimate contact state is a state in which the upper surface 241 of the heat retaining plate 24 is pressed upward to come into contact a contact surface 223, as the contact section, which is at the lower portion of the retention member 22, so that the thermal diffusion plate 26 in contact with the inner side of the endless belt 27, the heater 25 on the thermal diffusion plate 26, and the heat retaining plate 24 on the heater 25 are in intimate contact with each other.

When a pressing force is not applied to the outer surface 272 of the endless belt 27 by the pressure roller 3, the thermal diffusion member 26, the heater 25, and the heat retaining plate 24 are in a floating state (separated state) where the heat retaining plate 24 is away from the contact surface 223 of the retention member 22.

When the belt unit 2 is pressed against the pressure roller 3 at the time of printing (in other words, when the pressure roller 3 applies a force to the belt unit 2 against the pressing from the belt unit 2), the first wall 263 and the second wall 264 are guided by the first groove 221 and the second groove 222 of the retention member 22 supported by the stay 21, and the thermal diffusion plate 26 is pushed upward in substantially +z axis direction. The heater 25 and the heat retaining plate 24 inserted between the contact surface 223 at the lower portion of the retention member 22 and the first surface 261 of the thermal diffusion plate 26 are pressed by the thermal diffusion plate 26, the heater 25 and the heat retaining plates 24 are brought into intimate contact with each other, and part (in other words, an excessive portion in the grease) of applied grease may be pushed out onto the first surface 261 of the thermal diffusion plate 26. The grease between the thermal diffusion plate 26 and the heater 25 may assume the same state. The grease pushed out onto the first surface 261 of the thermal diffusion plate 26 is retained in the inner side of the first wall 263 and the second wall 264 in the first surface 261 of the thermal diffusion plate 26, thus does not adhere to the inner surface 271 of the endless belt 27.

As described above, with the fixing device 1 according to the embodiment, even when grease applied between the heater 25 and the thermal diffusion plate 26 or grease applied between the heater 25 and the heat retaining plate 24 leaks out onto the first surface 261 of the thermal diffusion plate 26, it is possible to prevent the grease from flowing to the outside of the first surface 261 by the first wall 263 and the second wall 264. Therefore, a situation does not occur in which the leaked out grease is mixed with slide grease between the inner surface 271 of the endless belt 27 and the second surface (lower surface) of the thermal diffusion plate 26, sliding performance is reduced, and a variation in heat transfer coefficient is caused. Consequently, it is possible to prevent insufficient heating of the developer image caused by outflow of the leaked grease, and a fixing failure which occurs as a consequence.

In addition, with the fixing device 1 according to the embodiment, between the contact surface 223 of the retention member 22 and the inner surfaces 271 of the endless belt 27, a structure is adopted in which a floating state (separated state) is assumed in which the heat retaining plate 24, and the heater 25 between the contact surface 223 and the first surface 261 of the thermal diffusion plate 26, and the thermal diffusion plate 26 are movable in the vertical direction (+z axis direction, −z axis direction). The heat retaining plate 24 is brought into an intimate contact state with the retention member 22 by the pressing force of the pressure roller 3

Thus, it is possible to press the thermal diffusion plate 26 and the endless belt 27 to the heater 25 regardless of a variation in the dimensions of the components. Thus, a fixing failure due to an insufficient amount of heating can be prevented.

In addition, with the fixing device 1 according to the embodiment, the thermal diffusion plate 26 has a small thickness in a range from 0.2 mm to 1.0 mm, and a simple shape in which a thin metal plate is bent in a U shape, as the material, thus the heat capacity can be reduced with a low cost, and the warm up (WU) time can be shortened.

<<3>> Modification

In the embodiment, the structure has been described in which the heat retaining plate 24 is provided between the upper surface 251 of the heater 25 and the contact surface 223 of the retention member 22. However, the fixing device 1 may adopt a structure in which the heat retaining plate 24 is not provided. In this case, the upper surface 251 of the heater 25 is in contact with the contact surface 223 of the retention member 22.

Also, in the embodiment, a case has been described where the image forming apparatus 100 is a color printer. However, the image forming apparatus 100 may be another apparatus utilizing an electrophotographic process. The image forming apparatus 100 may be, for instance, a multifunction peripheral (MFF), a facsimile, or a copy machine.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixing device comprising:

a belt unit; and a pressure member, wherein a medium is passed through a contact position between the belt unit and the pressure member so that a developer image is fixed onto the medium, wherein the belt unit includes:

a supporter;

an endless belt that is movably supported by the supporter and includes an outer surface which comes in contact with the pressure member;

a heater that is disposed inside the endless belt; and a thermal diffusion member that transmits heat generated by the heater to the endless belt, the thermal diffusion member includes:

a first surface in contact with the heater;

a second surface in contact with an inner surface of the endless belt;

a first wall provided upstream of the heater in a transport direction of the medium; and a second wall provided downstream of the heater in the transport direction, the supporter includes:

a first groove in which the first wall is provided; and a second groove in which the second wall is provided, in a state where a pressing force toward the supporter is applied to the outer surface of the endless belt by the pressure member, the thermal diffusion member and the heater are in contact with each other while being pressed toward a contact surface of the supporter.

2. The fixing device according to claim 1, wherein when the pressing force is not applied to the outer surface of the endless belt, the thermal diffusion member and the heater are in a floating state where the heater is away from the contact surface of the supporter.

3. The fixing device according to claim 1, further comprising first grease between the heater and the first surface of the thermal diffusion member.

4. The fixing device according to claim 3, wherein the first grease is thermal conductive grease.

5. The fixing device according to claim 1, further comprising a heat retaining member that is disposed between the heater and the supporter, and temporarily stores the heat generated by the heater, wherein when the pressing force is applied to the outer surface of the endless belt, the thermal diffusion member, the heater, and the heat retaining member are in contact with each other while being pressed toward the contact surface of the supporter.

6. The fixing device according to claim 5, wherein when the pressing force is not applied to the outer surface of the endless belt, the thermal diffusion member, the heater, and the heat retaining member are in a state where the heater is away from the contact surface of the supporter.

7. The fixing device according to claim 5, further comprising:

first grease between the heater and the thermal diffusion member; and second grease between the heat retaining member and the heater.

8. The fixing device according to claim 7, wherein the first grease and the second grease are thermal conductive grease.

9. The fixing device according to claim 1, wherein at least one of the first wall and the second wall includes an engagement section that is engaged with the supporter.

10. The fixing device according to claim 1, wherein the pressure member is a pressure roller, and the endless belt is moved in a circumferential direction of the endless belt by being driven by rotation of the pressure roller.

11. The fixing device according to claim 1, wherein the first groove has such a depth that a leading end of the first wall is out of contact with a bottom surface of the first groove, and the second groove has such a depth that a leading end of the second wall is out of contact with a bottom surface of the second groove.

12. The fixing device according to claim 1, wherein both ends of the thermal diffusion member in a width direction perpendicular to the transport direction are disposed outside both ends of the endless belt in the width direction.

13. The fixing device according to claim 1, wherein the thermal diffusion member is a metal plate with a thickness in a range from 0.2 mm to 1.0 mm, and the first wall and the second wall are bent sections of the metal plate.

14. An image forming apparatus comprising the fixing device according to claim 1.

* * * * *